US006588589B1

(12) United States Patent
Gustavson

(10) Patent No.: US 6,588,589 B1
(45) Date of Patent: Jul. 8, 2003

(54) EASY HANDLING SLEEVE FOR SMALL TOOLS

(76) Inventor: Ido H. Gustavson, P.O. Box 741, Micanopy, FL (US) 32667

( * ) Notice: Subject to any disclaimer, the term of this patent is extended or adjusted under 35 U.S.C. 154(b) by 34 days.

(21) Appl. No.: 09/784,275

(22) Filed: Feb. 16, 2001

(51) Int. Cl.[7] ..... B65D 85/20
(52) U.S. Cl. ..... 206/379; 206/349
(58) Field of Search ..... 206/349, 378, 206/379, 446, 443, 49.5, 459.5; 211/69; 16/270

(56) References Cited

U.S. PATENT DOCUMENTS

| | | | | | |
|---|---|---|---|---|---|
| 69,287 | A | * | 9/1867 | Weed | 16/270 |
| 2,792,934 | A | | 5/1957 | Rocchetti | |
| 2,938,746 | A | * | 5/1960 | Willman | 292/336.3 |
| 3,703,234 | A | * | 11/1972 | Howard | 206/349 |
| 3,910,412 | A | * | 10/1975 | Vargo | 206/335 |
| 4,019,632 | A | * | 4/1977 | Greenlee | 206/349 |
| 4,421,230 | A | * | 12/1983 | Stanton | 206/372 |
| 5,595,294 | A | * | 1/1997 | McKenzie et al. | 206/349 |
| 5,979,649 | A | | 11/1999 | Rosler | |
| 5,979,652 | A | * | 11/1999 | Rosler | 206/349 |

FOREIGN PATENT DOCUMENTS

| | | | |
|---|---|---|---|
| WO | WO 93/09040 | * | 5/1993 |

* cited by examiner

*Primary Examiner*—David T. Fidei
(74) *Attorney, Agent, or Firm*—Sven W. Hanson

(57) ABSTRACT

A novel storage sleeve has a longitudinal bore for retaining an elongated tool such as a drill bit and a handling tab. The handling tab provides a gripable element which is easily manipulated for retrieving the tool from a storage container or incidental flat surface. The handling tab includes a data surface including indicia such as text or numbers providing information associated with the tool. The storage sleeve includes a sleeve body having a rounded surface that enables a user's fingers to rotate and grasp the storage sleeve when located on a flat surface. The storage sleeve, or portions of the storage sleeve, may distinguishing characteristics to indicate related groups of tools such as a drill series. The invention also includes sets of sleeves retaining associated sets of drill bits. Each sleeve of the set having identifying information associated with the respective drill bit. A storage container is provided to conveniently present such sets of sleeves and bits. In one embodiment, a storage container includes rows of retaining clips which releaseably capture a set of sleeves in a manner to present the information contained on each sleeve and allow each sleeve and associated tool to be removed for use.

17 Claims, 2 Drawing Sheets

2a 2b 2c

EASY HANDLING SLEEVE FOR SMALL TOOLS

BACKGROUND OF THE INVENTION

The present invention relates to devices for storing and handling drill bits and similar small tools. Drill bits used in manually drilling or boring holes in objects come in a great variety of sizes and types. A typical user of drill bits, such as a mechanic or tradesman who works on a variety of projects, must have on hand a great variety and number of drill bits to accommodate the variety of needs in their work. The number of potential drill bits on hand is multiplied by the various drill series that are potentially used such as numbered and metric drill series.

The small size and shape of some drill bits introduces several problems in their use. Larger drill bits are relatively easily handled. However, smaller bits are grasped and handled with more difficulty simply due to their small size and round cross-section. In particular, grasping a round-shafted drill bit lying on a flat horizontal surface is problematic due to the small grip area—relative to human fingers—presented. In addition, drill bits have a tendency to roll such that when placed on a flat work area they may roll out of reach of the user, or into a hidden location. An additional problem with all drill bits, but particularly small sizes, is the lack of means of presenting drill data such as size information in a manner easily used. Typically, a drill size or number is stamped into the shaft base of many drill bits. However, this is impractical with small sized bits and tends to be obscured with use in all bits. All of these problems are made worse by the work habits of many users: a multitude of bits are stored grossly in a single location such as a tool box drawer. Some of these problems have been addressed with devices such as drill bit storage boxes having individualized bit storage compartments. For example, in the drill bit holder disclosed in U.S. Pat. No. 2,792,934 to Roccheti has individual storage slots to simplify the task of selecting and grasping drill bits. However, these types of devices do not address the problems encountered after the drill bit is removed from storage. Once the bare drill bit is removed from a storage container it is subject to the same problems of handling and identification. What is needed is a means of easily and individually handling small drill bits and similar tools and of retaining tool information with the tool.

SUMMARY OF THE INVENTION

The problems inherent with handling small tools such as drill bits are resolved in the present invention by a novel storage sleeve. The storage sleeve has a longitudinal bore for retaining an elongated tool such as a drill bit and a handling tab. The handling tab provides a gripable element which is easily manipulated for retrieving the tool from a storage container or incidental flat surface. The handling tab includes a data surface including indicia such as text or numbers providing information associated with the tool. The handling tab extends from one side of the storage sleeve. The storage sleeve preferably includes a sleeve body having a rounded surface that enables a user's fingers to rotate and grasp the storage sleeve when located on a flat surface. The storage sleeve, or portions of the storage sleeve, may also be specifically colored to differentiate from other colored storage sleeves to indicate related groups of tools such as a drill series. The storage sleeve may also have distinctive shapes or outlines to convey tool characteristics.

The invention also includes sets of sleeves retaining associated sets of drill bits. Each sleeve of the set having identifying information associated with the respective drill bit. A storage container is provided to conveniently present such sets of sleeves and bits. In one embodiment, a storage container includes rows of retaining clips which releaseably capture a set of sleeves in a manner to present the information contained on each sleeve and allow each sleeve and associated tool to be removed for use.

DESCRIPTION OF THE PREFERRED EMBODIMENTS

Figure 1:
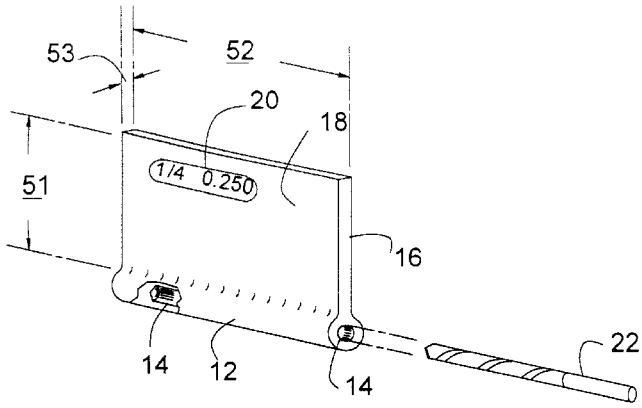
FIG. 1 depicts one embodiment of the preferred embodiment in combination with a typical twist drill bit.

FIG. 1 depicts a storage sleeve 10 including an elongated sleeve body 12 having a generally cylindrical longitudinal cavity or bore 14. Although the bore is shown bottoming within the sleeve body 12, in alternative embodiments the bore 14 extends fully through the sleeve body 12. Extending in one radial direction from the sleeve body 12 is a flat gripable handling tab 16. Stated differently, the bore 14 must be located at an extreme edge of the handling tab 16. The handling tap 16 includes at least one data surface 18 including indicia 20 providing tool data relating to the associated tool, in this case a twist drill bit 22.

In operation, an elongated tool such as the drill bit 22 is captured within the bore 14. Preferably, the tool is retained by friction of the bore side walls or other frictional or resilient structures within the bore that allow the tool to be inserted, retained by a minimal force, but also easily removed. The sleeve body 12 provides a connection to the handling tab 16. The handling tab 16 is sized for ease of location, grasping and handling. The handling tab carries tool data in the form of indicia 20 that is more easily viewed than data that might be placed directly on a small tool such as a drill bit shank. In this way, particularly small tools, such as small diameter drill bits, are provided a convenient device for handling by the user and relaying tool information. The larger size of the handling tab allows for a greater quantity of tool related information to be presented. Examples of data related to drills that are often desired but generally not readily available together with individual drills include conversion sizes and equivalent drill sizes, associated tap sizes, drill material information, and drill geometry information.

In general, the handling tab may be any size and shape. However, size minimization is desired to reduce storage volume. At the same time, the handling tab must be of a size to satisfy the requirement of manual handling ease. Preferably the handling tab has a height dimension 51 of at least ¼ inch and a length dimension 52 of at least ½ inch. Most preferably, a handling tab for small twist drills (less than ⅜ inch diameter) has a height dimension of ¾ inch and a length dimension in the range of 1 inch to 1.5 inch. These sizes provide effective grip and handling of small tools with the fingers. The handling tab is preferably rigid, although somewhat flexible handling tabs may also be used. The handling tab is thin to reduce volume, preferably as thin as possible while still being flexurally rigid as discussed. The required thickness is somewhat dependent upon the material of the storage sleeve. High density plastics are preferred, although metal, wood, compressed paper and similar materials are also contemplated. A preferred range of thickness dimension 53 for a plastic storage sleeve is 1/16 to 1/8 inch. The length of the sleeve body 12 is preferably long enough to provide for sufficient bore length to receive at least half the body of the associated tool. On very long, non-standard, drill bits such a sleeve body length may be impractical. In some configurations, the sleeve body 12 is significantly longer than the handling tab 16. The length of the bore 14 must be less than the tool length to enable the tool to be grasped by the fingers and removed. Preferably, when fully inserted in the bore, the tool extends at least one inch from the sleeve body 12 to enable a sure grip.

Figure 2:
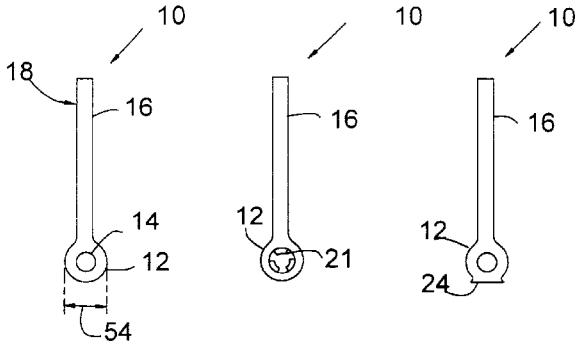
FIGS. 2*a*, 2*b*, and 2*c* depict various alternative cross section profiles of the storage sleeve of the present invention.

FIGS. 2*a*, 2*b*, and 2*c* depict end views of three alternative storage sleeves according to the present invention. FIG. 2*a* corresponds to the embodiment of FIG. 1. FIG. 2*b* depicts a plastic storage sleeve 10 having thin radial flanges 21 extending inward from the inner wall of the bore 14. These flanges are sufficiently thin (in the axial direction) such as to resiliently bend and deform when a tool is pushed into the bore. The flanges 21 grip the tool while allowing easy removal and also accommodates variation in size. Other similar mechanisms are also contemplated.

Figure 3:
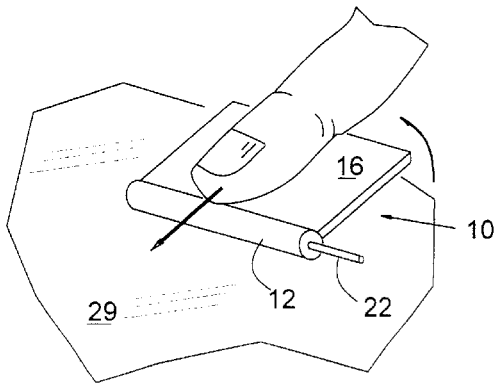
FIG. 3 depicts a handling operation of the invention.

In the figures, the sleeve body 12 is shown having an outer diameter or width dimension 54 greater than the thickness dimension 53 of the handling tab. This relative dimension, together with the rounded profile of the sleeve body 12 provides a mechanism for the following beneficial operation of the invention. When a tool such as a drill bit is combined with a storage sleeve as described and it then and placed on a flat horizontal surface, the handling tab will inevitably lie flat against the horizontal surface—somewhat held up by the larger sleeve body. By placing a finger against the side of the sleeve body, particularly into the intersection of the handling tab 16 and sleeve body 12, and pushing across and away from the handling tab, the storage sleeve is rotated to bring the handling tab into an upright orientation. At that point the handling tab is easily grasped between the fingers. This operation is shown in FIG. 3 in which a storage sleeve 10 is placed on a flat surface 29 and manipulated as just discussed. In FIG. 3, arrows indicate the relative motion of the user's finger and of the handling tab. To enable such operation the sleeve body must have a rollable outer surface such as provided by the outer circumference of a circular cross-section. In alternative embodiments, where the sleeve body width dimension 54 is equal to, or less than the handling tab thickness dimension 53 such operation is hindered. Such embodiments, while possessing other benefits of the present invention, are not preferred. Similarly, embodiments such as shown in FIG. 2*c*, having obstructions to the storage sleeve rotation described above, are similarly less preferred. In FIG. 2*c*, an alternative embodiment of the invention includes a widened flat surface 24 on the sleeve body 12 oriented to allow the storage sleeve 10 to be placed upright on a horizontal surface. Such embodiments, that do not have a rollable surface, do not share the advantage of the above operation.

One embodiment of the invention includes a series of drill bits, each having an associated storage sleeve including indicia. Each storage sleeve of the series also has a common distinguishing characteristic identifying a common drill bit parameter. Contemplated distinguishing characteristics include, but are not limited to, an identifying color or color pattern. The distinguishing characteristic functions to provide easily visually identifiable indication of the common parameter shared by the associated tools. For example a series of metric drill bits may have handling tabs of a common red color. This distinguishes the series from a second series of drill bits having handling tabs of a common blue color identifying a "numbered" drill bit series. Alternatively, but in like manner, various drill bits may be distinguished by differing handling, tab outline shapes or notches formed in the handling tabs.

Figure 4:
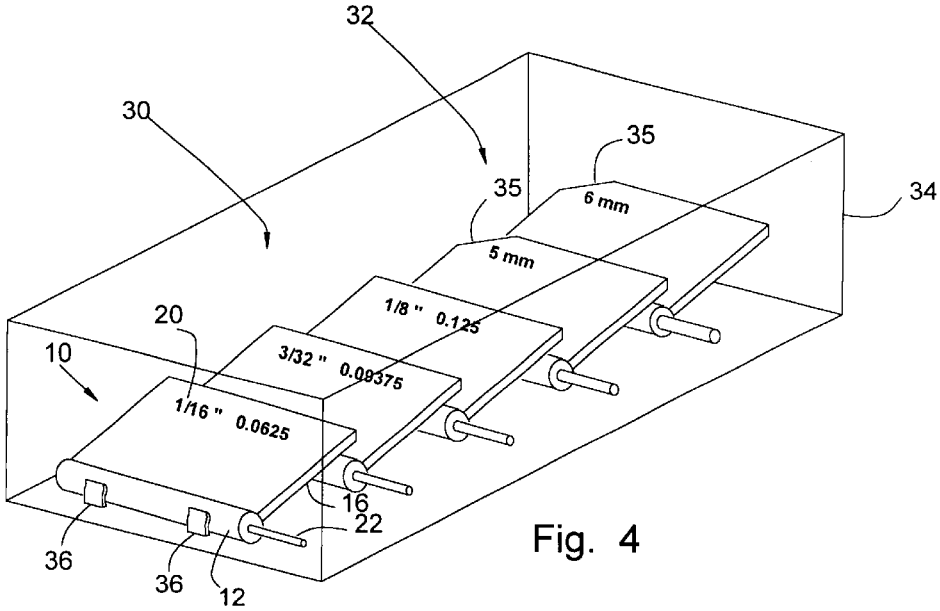
FIG. 4 depicts a storage container including a set of storage sleeves.
Figure 5:
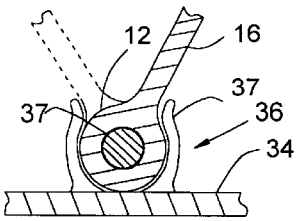
FIG. 5 depicts a cross-section of the storage container of FIG. 4 showing the configuration of retaining clips for retaining storage sleeves.
Figure 6:
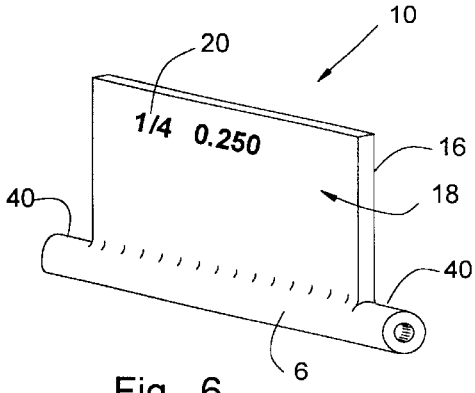
FIG. 6 depicts an alternative storage sleeve embodiment configured to be held in a storage container.

FIG. 4 depicts storage sleeves 10 of two series 30, 32 of drill bits retained in a storage container 34. For clarity, the storage container is shown in transparent outline. The two series 30, 32 are identified by different distinguishing characteristics. The first series 30 is identified to the user by the distinguishing characteristic of a rectangular outline shape, contrasting with the handling tabs of the second series 32 having a corner cutout 35. This readily identifies each drill bit 22 as belonging to one or the other series. This allows both series to be stored together as a set or kit within the storage container 34 while still being easily identified and selected. In one embodiment of such a storage container and kit, the storage container includes retaining clips 36 to receive and releasably retain the individual storage sleeves 10 in relative position. By spacing the retaining clips 36 appropriately, the handling tabs 16 of each storage sleeve 10 may be placed in a angled orientation, as shown, to reduce storage volume. This spacing and angled orientation also results in adjacent handling tabs overlapping to expose the distal edge portions of the handling tabs. Drill bit data indicia 20 placed in these regions allows the drill bits to be easily identified. The storage container 34 may also include matching drill indicia placed adjacent each set of retaining clips to allow proper replacement of drills in storage sleeves that have been previously removed. The storage container may be formed in any of a variety of ways in a variety of materials. Preferably the storage container opens in a manner to expose all the drill bits and storage sleeves to allow viewing of the exposed indicia. FIG. 5 depicts a cross-section of the storage container of FIG. 4 in the region of the retaining clips to show their operation in more detail. The retaining clips 36 each consist of a pair of resilient arms 37 configured to partially encircle a sleeve body 12. The arms 37 are preferably spaced and shaped to allow rotation of the handling tab 16 to create the overlapping configuration of adjacent handling tabs discussed above. One or more, but preferably two, retaining clips are provided for each storage sleeve. In the configuration shown, the retaining clips are molded integral with the bottom of the storage container 34. In alternative configurations, the retaining clips are molded into rails secured within the storage container. The rails may be inclined to provide more clear view of the handling tabs. FIG. 6 depicts a preferred storage sleeve 10 having extended sleeve body portions 40. These extended portions 40 are clear of the handling tab 16 and are intended to be aligned with the retaining clips in a storage container such as in FIG. 4. This configuration allows increased relative rotation of the handling tab to aid in forming the overlapping configuration discussed above.

In alternative embodiments of the invention, the sleeve body 12 is not contiguous, but is formed of two or more spaced sleeve sections. Such embodiments can provide the desired functions described above, but are not preferred due to the increased necessity of guiding the tool into multiple sleeve sections. In addition, spaced sleeve sections make difficult the righting and grasping operation discussed to retrieve a tool from a flat surface.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A storage device for retaining and handling small elongated tools comprising:

an elongated sleeve body having a longitudinal bore and having a circular cross-section defining a rollable surface; and no more than one flat handling tab extending from the sleeve body in one radial direction outward from the rollable surface, such that the rollable surface may be rolled against a flat working surface to bring the sleeve tab from a first aspect lying against the working surface to a upright aspect with respect to the working surface, the tab having a data surface including tool data indicia.

2. The storage device of claim 1, wherein:

the handling tab extends a height of ¾ inch from the rollable surface, and has an length in the range of 1 to 1.5 inches.

3. The storage device of claim 2, further comprising:

multiple resilient gripping elements extending from the sleeve body inside the bore.

4. A tool kit providing ease of handling of elongated tools, the kit comprising:

an elongated sleeve body having a longitudinal bore and having a circular cross-section defining a rollable surface;

an elongated tool removably disposed in the bore; and no more than one flat handling tab extending from the sleeve body in one radial direction from the rollable surface outward; such that the rollable surface may be rolled against a flat working surface to bring the tab from a first aspect lying against the working surface to a upright aspect with respect to the working surface.

5. The tool kit of claim 4, wherein:

at least one half the tool is disposed in the bore.

6. The tool kit of claim 5, wherein:

the tool extends at least one inch from the bore.

7. The tool kit of claim 4, further comprising:

a first plurality of additional like sleeve bodies and associated tabs; and a first plurality of additional elongated tools received in the sleeve bores, the first plurality of tools having tools of at least two different diameter size.

8. The tool kit of claim 7, wherein:

each tool of the first plurality of tools has a unique size; and wherein each tab has unique indicia.

9. The tool kit of claim 8, wherein:

all sleeve bodies have a first common distinguishing characteristic.

10. The tool kit of claim 9, wherein:

the distinguishing characteristic is a first color.

11. The tool kit of claim 9, further comprising:

a second plurality of sleeves bodies and associated tabs and elongated tools, the second plurality of sleeve bodies all having a second common distinguishing characteristic.

12. The tool kit of claim 11, wherein:

the first distinguishing characteristic comprises at least a first color and the second distinguishing characteristic comprises at least a second color.

13. The tool kit of claim 8, further comprising:

a storage container; and a plurality of retaining clips disposed within the storage container and configured for releasably retaining the sleeve bodies within the storage container, the retaining clips also configured to allow the handling tabs to be positioned in an angled orientation.

14. A tool providing easy handling comprising:

a flat handling tab having a straight edge;

an elongated tool receptacle connected parallel to the edge;

an elongated tool removably disposed in the receptacle and extending from the receptacle;

the handling tab having tool associated indicia; and the receptacle having a uniform circular cross-section forming a rollable surface, the rollable surface configured to roll against a flat working surface to bring the tab from a first aspect lying against the working surface to a upright aspect with respect to the working surface.

15. The tool of claim 14, wherein:

the tool comprises a twist drill bit; and the receptacle has a longitudinal bore, the bore having a diameter to receive the drill bit.

16. The tool of claim 15, wherein:

the handling tab has a width dimension in the range of ¼ inch to 1 inch and an orthogonal length dimension of at least ½ inch.

17. A drill bit kit providing ease of handling of drill bits, the kit comprising:

a plurality of storage sleeves having a common distinguishing characteristic, each storage sleeve comprising:

an elongated sleeve body having a longitudinal bore, a drill bit received in the bore, a handling tab extending in one radial direction outward from the sleeve body, the tab having a data surface including drill bit data indicia;

a storage container; and a plurality of retaining clips disposed within the storage container and configured for releasably retaining the storage sleeves within the storage container, the retaining clips also configured to allow the handling tabs to be positioned in an angled orientation.

* * * * *